US008935929B1

(12) United States Patent
Prater

(10) Patent No.: US 8,935,929 B1
(45) Date of Patent: Jan. 20, 2015

(54) HVAC UNIT SUSPENSION SYSTEM AND METHOD

(71) Applicant: Richard L. Prater, Keller, TX (US)

(72) Inventor: Richard L. Prater, Keller, TX (US)

( * ) Notice: Subject to any disclaimer, the term of this patent is extended or adjusted under 35 U.S.C. 154(b) by 188 days.

(21) Appl. No.: 13/847,550

(22) Filed: Mar. 20, 2013

(51) Int. Cl.
*F25D 3/12* (2006.01)
*F24F 13/32* (2006.01)
*B23P 19/00* (2006.01)

(52) U.S. Cl.
CPC *F24F 13/32* (2013.01); *B23P 19/00* (2013.01)
USPC ..... 62/56; 62/259.1; 62/288

(58) Field of Classification Search
CPC ..... F24F 13/32; F24F 13/02; F24F 13/0254; F24F 13/22; B23P 19/00
USPC ..... 62/56, 259.1, 317, 150, 285, 288, 291, 62/298; 312/236, 401, 408; 29/428, 29/890.035, 890.043
See application file for complete search history.

(56) References Cited

U.S. PATENT DOCUMENTS 2,549,747 A * 4/1951 Leeson ..... 62/135
3,206,371 A * 9/1965 McGrath ..... 376/355
4,064,003 A * 12/1977 Newton ..... 376/283
4,687,604 A * 8/1987 Goettl ..... 261/29
5,613,554 A * 3/1997 Bull et al. ..... 165/150
5,694,785 A * 12/1997 Balentine ..... 62/275
6,167,717 B1 * 1/2001 Dudley et al. ..... 62/291
6,497,255 B1 * 12/2002 Adams et al. ..... 138/149
6,745,580 B1 * 6/2004 Brown ..... 62/129
6,978,909 B2 * 12/2005 Goetzinger et al. ..... 220/571
7,284,388 B2 * 10/2007 Yoshida ..... 62/285
D653,064 S 1/2012 Lutt
2008/0034776 A1 * 2/2008 Jensen ..... 62/305

* cited by examiner

*Primary Examiner* — Mohammad M Ali
(74) *Attorney, Agent, or Firm* — Dan Brown Law Office; Daniel R. Brown

(57) ABSTRACT

An HVAC evaporator unit and emergency drain pan are suspended from an existing overhead structure. Plural lateral beams are disposed along a horizontal plane, which support a pair of support beams, which support the HVAC evaporator unit. The beams are connected to each other by plural pivot connectors, which thereby defines a grid arrangement that is foldable about the plural pivot connectors. Plural pan support beams are suspended by pairs of pan hangers, which are connected to the ends the plural lateral beams. Plural flexible hangers are connected to ends of the plural lateral beams, for connection to and suspension from the existing overhead support structure. Hanger clamps are used to adjust the plural flexible hangers to facilitate height adjustment and leveling.

18 Claims, 7 Drawing Sheets

2

HVAC UNIT SUSPENSION SYSTEM AND METHOD

BACKGROUND OF THE INVENTION

1. Field of the Invention

The present invention relates to heating ventilating and air conditioning (HVAC) equipment installation. More particularly, the present invention relates to an apparatus and method for suspending HVAC evaporator units, air handlers, furnaces and emergency drain pans from existing overhead structures.

2. Description of the Related Art

Residential and commercial heating, ventilating, and air conditioning (hereinafter "HVAC") equipment comprises a variety of system components. In systems that deliver heating and cooling by force air circulation, it is necessary to transfer heat to and from a circulating air stream in order to accomplish the desired heating and cooling functions. In the case of heating, a resistive electric heating element, a condenser coil, or a furnace is employed. A furnace includes a heats source, usually a petroleum fuel burner, and a heat exchanger. The heat exchanger is a located in the circulating air stream to impart heat energy thereto. In the case of cooling, a refrigerant cycle system is used, which consists of a compressor, condenser unit, and an evaporator unit. The evaporator unit absorbs heat and it thus placed into the circulating air stream to remove heat therefrom. In some systems, the condenser and evaporator functions can be selectively reversed, so the heat may be added to the circulating air stream, and such a system is referred to as a heat pump. The components have common names used in the trade. A petroleum fuel burner and heat exchanger is generally called a furnace. An evaporator coil unit can be added to the furnace to create a combination unit. An evaporator unit for a circulating air system that does not include a furnace is generally called an air handler, which can also be used for a heat pump system.

A significant characteristic of a forced air cooling systems is that moisture will be condensed out of the circulating air stream as it is cooled below the ambient dew point. Thus, an HVAC evaporator unit requires a drain system to carry the condensed water (condensate) away. Of course, HVAC evaporator units are manufactured with a primary drain system. However, over a period of time, it is no uncommon for the primary drain system to become obstructed with various types of debris. When this occurs, water will spill out of the HVAC evaporator unit and drain away. This can be problematic if not controlled, as water damage to surrounding structures and equipment can occur. Particularly where the HVAC equipment is located above the conditioned space, such as in an attic of a residence, for example. Designers and technicians have addressed the secondary drain issue by installing an emergency drain pan underneath the HVAC evaporator unit to catch the spilled water. These are also referred to as drip pans. Thus, when an HVAC system is installed, both the hair handling equipment, including the HVAC evaporator unit, and the emergency drain pan must be supported in the proper orientation to accomplished the aforementioned functions.

Each HVAC system installation has its own particular environment, constraints, space, and support characteristics and requirements. It is common for HVAC system air handlers to be installed in attics with ductwork connected to the conditioned space. However, other configurations are also known, such as basement, rooftop, and mechanical room installations. Technicians generally custom tailor the installation for every job. This includes building a support structure to carry the weight of the air handler, evaporator unit, and furnace, as well as the emergency drain pan. This is a time consuming task that significantly adds to the cost of installing an HVAC system. Another significant consideration in HVAC system design and installation is noise control. Consumers generally prefer that the system remain unnoticed during operation, so designers and technicians attempt to minimize noise wherever practicable. Since air handling equipment vibrates and produces noise, it is preferable to decouple that noise from the conditioned space where possible. One technique for achieving this is to support the equipment from a structure not immediately adjacent to the conditioned space. For example, in the case of a residential attic installation, the equipment may be hung from the attic rafters above, rather than from the ceiling joists below. Thus it can be appreciated that there is a need in the art for an apparatus and method for installing and supporting HVAC equipment that requires less labor, is flexible in its application, and that addresses both the equipment support, noise abatement, and condensation issued noted above.

SUMMARY OF THE INVENTION

The need in the art is addressed by the apparatus and methods of the present invention. The present disclosure teaches an apparatus for suspending an HVAC evaporator unit above an emergency drain pan from an existing overhead structure. The apparatus includes plural lateral beams disposed along a horizontal plane, and a first support beam and a second support beam, for engaging and supporting the HVAC evaporator unit, arranged substantially in parallel to one another, located on top of the plural lateral beams, and each connected to each of the plural lateral beams by a corresponding one of plural pivot connectors, which thereby defines a grid arrangement that is foldable about the plural pivot connectors. Plural pan support beams, each aligned below a corresponding one of the plural lateral beams, and each suspended by a pair of pan hangers, which are connected at two ends of the corresponding one of the plural lateral beams. Plural flexible hangers are connected to corresponding ends of the plural lateral beams, for connection to and suspension from the existing overhead support structure/Plural hanger clamps adjustably engage the plural flexible hangers into adjustable length loops to facilitate height adjustment and leveling of the horizontal plane, as well as the emergency drain pan and the HVAC evaporator unit.

In a specific embodiment of the foregoing apparatus, the plural lateral beams, the first support member, the second support member, and the plural pan support beams are fabricated from metal structural tubing. In another specific embodiment, the a first support beam and a second support beam are spaced apart a distance that effectively supports HVAC evaporator units in the two ton to five ton cooling capacity range, without the need to adjust the distance.

In a specific embodiment of the foregoing apparatus, the plural pivot connectors are threaded fasteners connected between the plural lateral beams and the first support beam or the second support beam. In another specific embodiment, the grid arrangement is a parallelogram. In another specific embodiment, the pair of pan hangers are fabricated from metal cable. In a refinement to this embodiment, the pair of pan hangers are connected to the corresponding one of the pair of plural lateral beams by passing the metal cable through a hole formed therethrough and terminating the metal cable with cable crimp connectors.

In a specific embodiment of the foregoing apparatus, the plural flexible hangers are fabricated from metal cable. In a refinement to this embodiment, the plural flexible hangers are connected to the plural lateral beams by passing metal cable through corresponding holes formed through ends of the plural lateral beams. In a further refinement, the plural hanger clamps are spring loaded metal cable clamps.

The present disclosure also teaches a method of suspending an HVAC evaporator unit and an emergency drain pan using an apparatus consisting of plural lateral beams disposed along a horizontal plane, and a first and second support beam arranged substantially in parallel to one another, located on top of the plural lateral beams, and each connected to each of the plural lateral beams by a corresponding one of plural pivot connectors, which thereby defines a grid arrangement that is foldable about the plural pivot connectors. The apparatus of this method also includes plural pan support beams, each aligned below a corresponding one of the plural lateral beams, and each suspended by a pair of pan hangers, which are connected, one each, at two ends of the corresponding one of the plural lateral beams. The method includes the steps of positioning the apparatus below an existing overhead structure, and, unfolding the apparatus about the plural pivot connectors into a square grid arrangement. It further includes the steps of attaching plural flexible hangers between the existing overhead structure and corresponding ends of the plural lateral beams, and, engaging the HVAC evaporator unit on the first support beam and a second support beam. Then, adjusting the height and leveling the apparatus along a horizontal plane using plural hanger clamps connected to the plural flexible hangers, and, installing the emergency drain pan on the plural pan support beams.

In a specific embodiment of the foregoing method, the first and second support beams are spaced apart for supporting an HVAC evaporator unit having a capacity in the two ton to five ton cooling capacity range. In another specific embodiment, the grid arrangement is unfolded from a parallelogram arrangement. In a refinement to this embodiment, the method further includes the step of removing the apparatus in the parallelogram arrangement from a shipping container.

In a specific embodiment, wherein the plural flexible hangers are fabricated from metal cable, the foregoing method further includes the steps of passing the metal cables through corresponding holes formed through ends of the plural lateral beams. In a refinement to this embodiment, the method further includes the steps of drilling plural holes through the overhead support structure, and passing the metal cables through the plural holes. In another refinement, the plural hanger clamps are spring loaded metal cable clamps.

DESCRIPTION OF THE INVENTION

Figure 1:
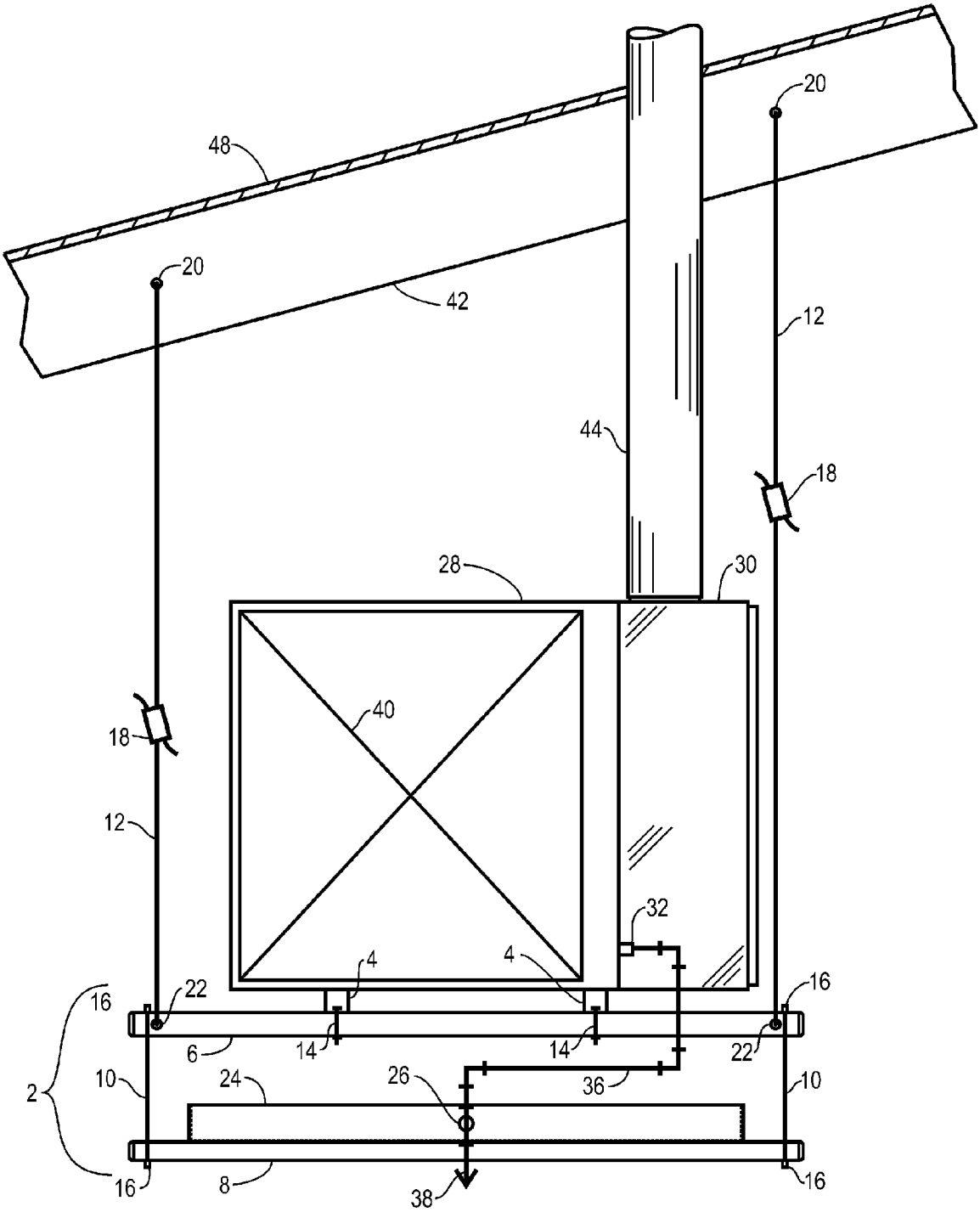
FIG. 1 is an end view drawing of an installed HVAC system according to an illustrative embodiment of the present invention.

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope hereof, and additional fields in which the present invention would be of significant utility.

In considering the detailed embodiments of the present invention, it will be observed that the present invention resides primarily in combinations of steps to accomplish various methods or components to form various apparatus and systems. Accordingly, the apparatus and system components and method steps have been represented where appropriate by conventional symbols in the drawings, showing only those specific details that are pertinent to understanding the present invention so as not to obscure the disclosure with details that will be readily apparent to those of ordinary skill in the art having the benefit of the disclosures contained herein.

In this disclosure, relational terms such as first and second, top and bottom, upper and lower, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a" does not, without more constraints, preclude the existence of additional identical elements in the process, method, article, or apparatus that comprises the element.

The teachings of the present disclosure provide substantial benefits in the installation of HVAC equipment, particularly where the equipment is supported from an existing overhead structure. HVAC equipment is commonly suspended from above because this approach reduces noise coupling to adjacent structures and generally simplifies the support structure in that the suspension members are under tension forces, rather than compression and bending forces. As such, installers can utilize strapping, rope, cord, chains, cable, and other suitable tension load carrying structural members. However, it remains necessary to utilize some lateral members to support the HVAC equipment, and these lateral members function as beams under bending loads. This arrangement is generally required because HVAC equipment manufacturers generally require that their equipment rest upon a rigid structure placed underneath that equipment. Examples of such equipment are furnaces, air handlers, evaporator units, heat exchangers, filter boxes, plenums, ductwork, and so forth.

Technicians and installers of HVAC equipment usually fabricate a support platform using dimensioned lumber. As such, this is a part of the installation process that is required on many installations. It is time consuming and requires some design, procurement, and fabrication skills that are unique to each job. In other words, the installer needs to figure out how to support the equipment, get the materials, move the materials into the construction area, gather needed tools, and then build the support structure. Often times, this is done in a cramped and uncomfortable environment that has poor lighting, as will be appreciated by those skilled in the art.

The present invention advances the art by providing an HVAC equipment support system and method that is preassembled, light weight, easy to position, easy to deploy and which can be placed into service with minimal tools and labor. This represents a substantial time savings for the installer and a corresponding reduction in labor costs as well. In addition, the present invention incorporates a structural support for an emergency drain pan that is placed under an HVAC condenser unit, as was discussed hereinbefore.

Reference is directed to FIG. 1, which is an end view drawing of an installed HVAC system according to an illustrative embodiment of the present invention. In this embodiment, an HVAC condenser unit 28 and a furnace 30 are supported on a support frame 2 using plural flexible hangers 12, which are hung from an overhead structure consisting of roof rafters 42 and a roof 48. In the illustrative embodiment, the flexible hangers 12 are steel cables. The plural cables 12 are inserted through holes 20 drilled through the rafters 42, although the cables 12 can be looped around, or through, any suitable overhead structure, as will be appreciated by those skilled in the art. The furnace 30 has a flue vent 44, which passed through the roof 48 in the conventional fashion. The position height and leveling of the support frame 2 is accomplished by adjusting the lengths of cable loops 12. The length adjustment is readily accomplished without the need for tools using spring loaded cable clamps 18 installed on each of the corresponding cable loops 12. In the illustrative embodiment, the cables 12 are conventional 3/16" stranded steel cable and the cable clamps 18 are Duro Dyne Corporation Dyna-Tite model CL23 cable clamps (www.durodyne.com). Those skilled in the art will appreciate that other types of cable and other types of cable clamps could be employed. Additionally, the flexible hangers 12 could also be chain, rope, cord, straps, rods, or other suitable structural tension members.

The support frame 2 of the illustrative embodiment comprises a number of components that function cooperatively. The HVAC condenser unit 28 and furnace 30 rest upon a pair of support beams 40. The support beams 4 rest upon plural lateral beams 6, which are connected to the support beams 4 with plural pivot connectors 14. The plural pivot connectors 14 are disposed at each intersection of a support beam 4 and a lateral beam 6. The function of the pivot connectors 14 will be more fully discussed hereinafter. The lateral beams 6 have mounting hole 22 formed there through, located near each end. The cables 12 are connected to the mounting holes 22, which suspend the support frame 2 from the overhead structure 42. The lateral beams 6 are also utilized to support an emergency drip pan 24 as follows. Plural pan hangers 10 extend downwardly from the ends of the plural lateral beams 6 to support plural pan support beams 8, upon which the emergency drip pan 24 is placed. In the illustrative embodiment, the plural pan hangers 10 are fabricated from steel cable. The steel pan hanger cables 10 pass through holes formed in the ends of the plural lateral beans 6 and the plural pan support beams 8. The steel pan hanger cables 10 are retained using cable crimp connectors 16 at each end. These connections are made at the time of manufacture so the installer need not do this in the field. Once the emergency drip pan 24 is located on the plural pan support beams 8, the drain plumbing 36 can be connected. The drain plumbing 36 is connected to the primary condensate drain 32 in the HVAC evaporator unit 28, and is routed to connect to an emergency drip pan drain 26, and then is routed away 38 to a suitable location. Alternatively, the primary drain 32 and the emergency drip pan drain 26 can be plumbed with separate pipes to different locations.

Figure 2:
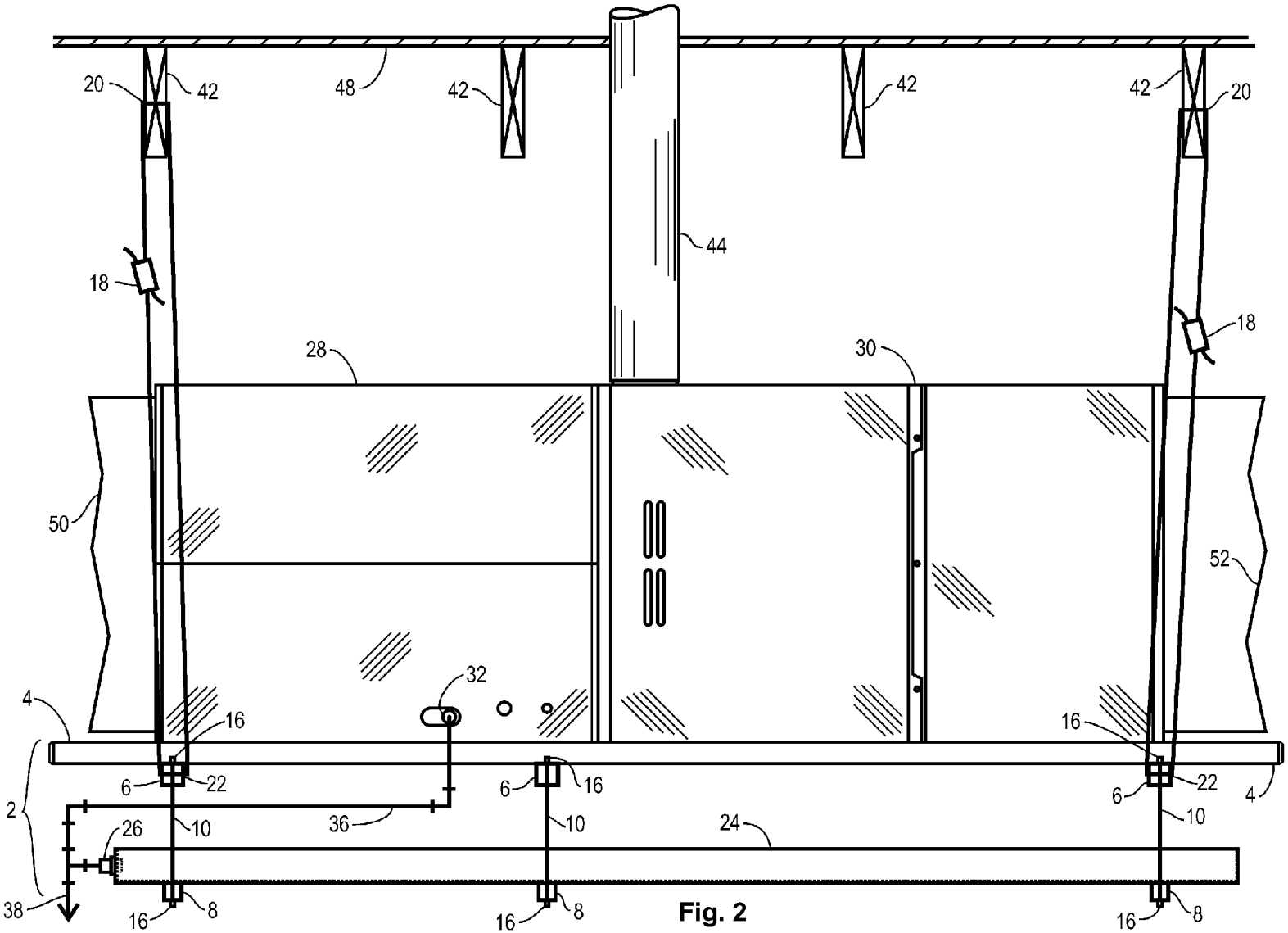
FIG. 2 is a side view drawing of an installed HVAC system according to an illustrative embodiment of the present invention.

Reference is directed to FIG. 2, which is a side view drawing of the installed HVAC system according to an illustrative embodiment of the present invention. From this side view perspective, the looped arrangement of the flexible cable hangers 12 can be more readily appreciated. Holes 20 are drilled through the rafters 42 below the roof 48 so that the cable 12 can be passed there through. The cables 12 also pass through holes 22 formed through the lateral beams 6. The cable clamps 18 are use to join the ends of the cables 12 into loops. By adjusting the position of the clamps 18, the length of the cable loops 12 can be changes to set the lateral support beams 6 along a horizontal plane, thereby leveling the support beams 4 as well as the HVAC evaporator unit 28 and the furnace 30. The pan hangers 10 also hold the pan support beams 8 and the emergency drip pan 24 in a level position as well. This side perspective also illustrates a return plenum 52 connected to the furnace 30 inlet and a supply plenum 50 connected to the outlet of HVAC evaporator unit 28. Note that the lateral beam 6 and flexible hanger 12 arrangement provides clearance for these plenums 50, 52. Also note that this illustrative embodiment employs three lateral beams 6, but that only the end two have support cables 12 connected to them. The support beams 4 support the center lateral beam. It is desirable to have the center lateral beam so that there can be a center pan support beam 8. The emergency drain pan 24 is a light gauge sheet metal pan that benefits from additional support. The pan hangers 10 and crimp connectors 18 provide the support for all three pan support beams 8. The drain connector s 32, 26 and drain plumbing 36, 38 is also illustrated in FIG. 2.

Figure 3:
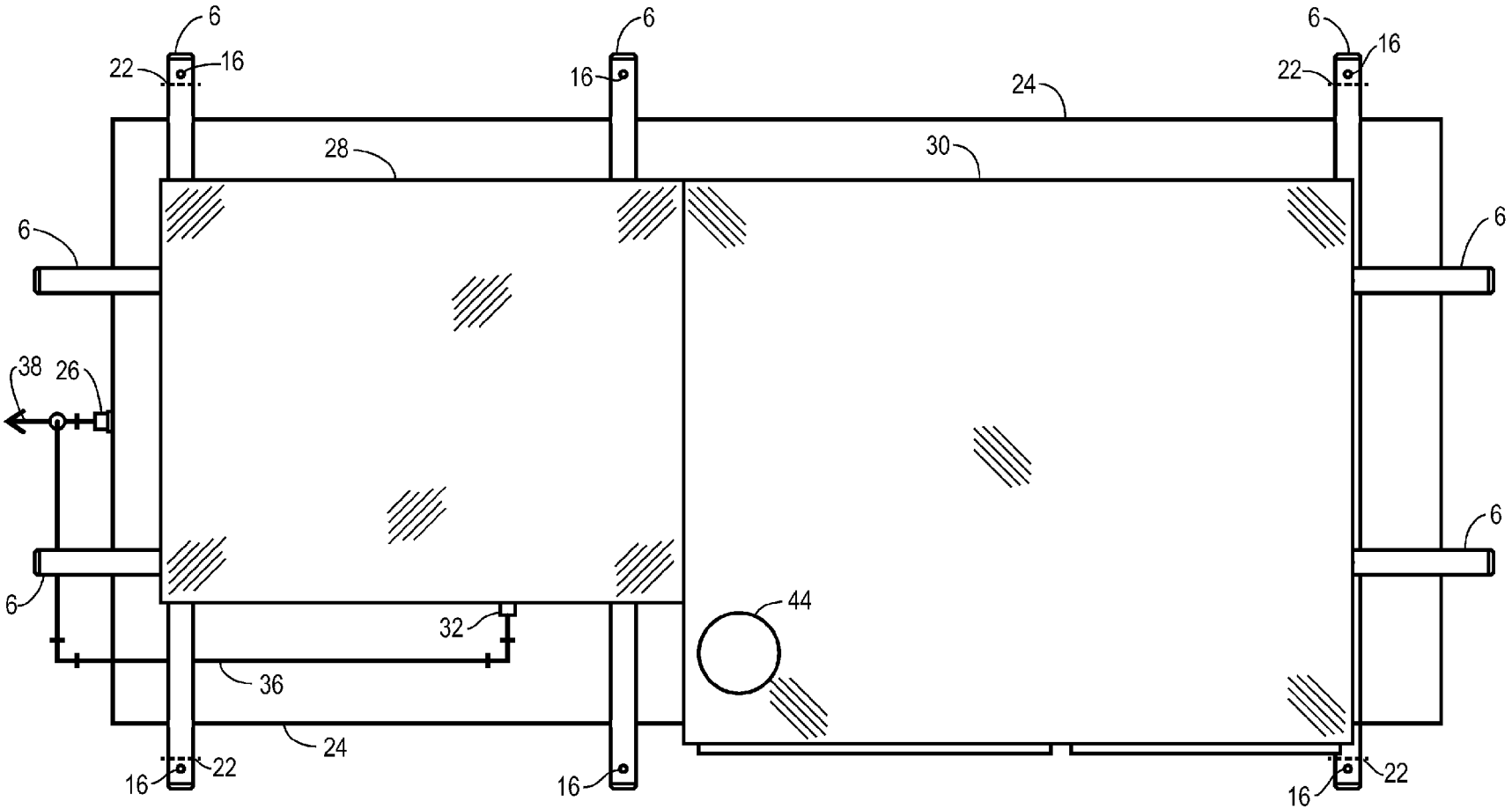
FIG. 3 is a top view drawing of an installed HVAC system according to an illustrative embodiment of the present invention.

Reference is directed to FIG. 3, which is a top view drawing of the installed HVAC system according to an illustrative embodiment of the present invention. This view illustrates that the location of the mounting holes 22 in the lateral beams 6 are positioned near the ends of the lateral beams 6 so as to clear the location of the furnace 30 and the HVAC evaporator unit 28. Also note that the location of the crimp connectors 16 for the pan hangers (not shown) are also located toward the ends of the lateral beams 6 for clearance for the emergency drain pan 24 below. The location of the HVAC evaporator unit drain 32, the drain plumbing 36, and the emergency drain pan drain 26 are also illustrated in FIG. 3.

Figure 4:
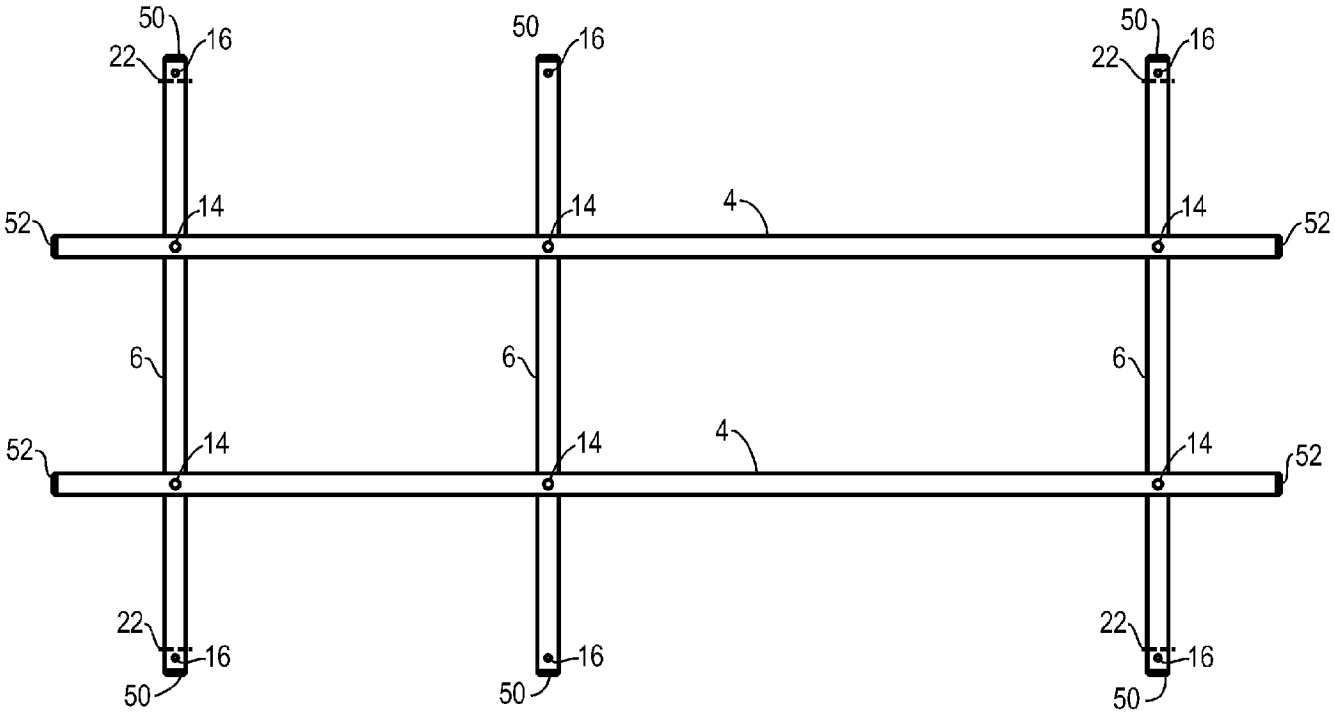
FIG. 4 is a top view drawing of a support apparatus according to an illustrative embodiment of the present invention.
Figure 5:
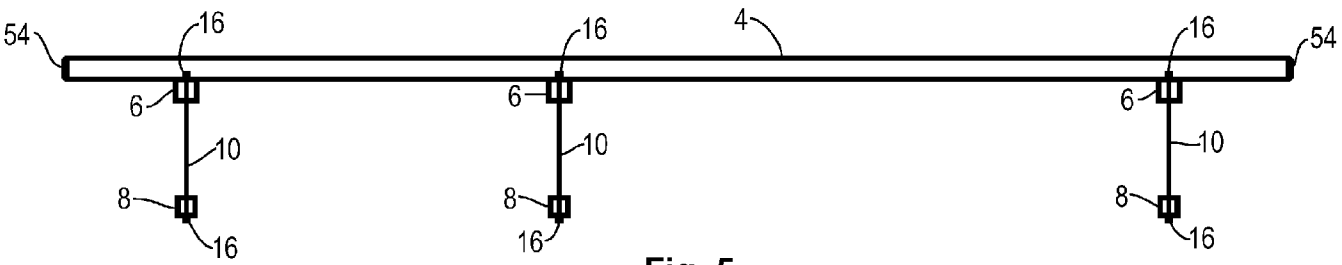
FIG. 5 is a side view drawing of a support apparatus according to an illustrative embodiment of the present invention.
Figure 6:
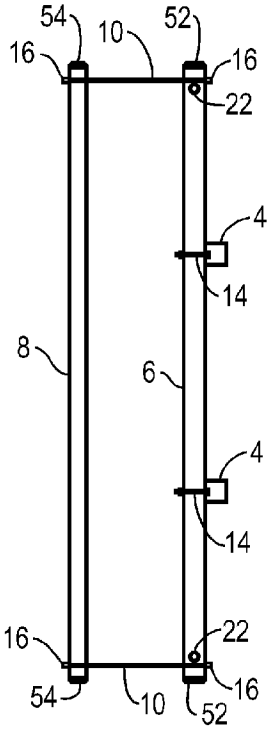
FIG. 6 is an end view drawing of a support apparatus according to an illustrative embodiment of the present invention.

Reference is directed to FIG. 4, FIG. 5, and FIG. 6, which are top view, side view, and end view drawings, respectively, of a support frame apparatus 2 according to an illustrative embodiment of the present invention. A pair of support beams 4 are connected to three lateral beams 6 using plural pivot connectors 14, which are disposed at each beam intersection. The pivot connectors 14 fasten the beams 4, 6 together, but allow them to rotate about the vertical axis of these joints. In the illustrative embodiment, the support beams 4 are seventy-two inches long and are fabricated form 1-¼ inch square steel tubing. The open ends are sealed with rubber plugs 52. The lateral beams 6 are thirty-six inches long and are also fabricated from 1¼ inch square steel tubing. The end lateral beams 6 have holes 22 formed through for receiving the flexible hangers (not shown). The open ends of the lateral beams 6 are also sealed with rubber plugs 50. The pan support beams 8 are also thirty-six inches long, but are fabricated from one inch square steel tubing. The open ends of the pan support beams 8 are also sealed with rubber plugs 54. The pan hangers 10 are fabricated from 3/16 inch steel cable, which passes through the ends of the lateral beams 6 and the ends of the pan support beams 8. The pan hangers are retained in place using cable crimp connectors 16 at each end. In the illustrative embodiment, the pan hangers 10 are 7½ inches long.

Figure 7:
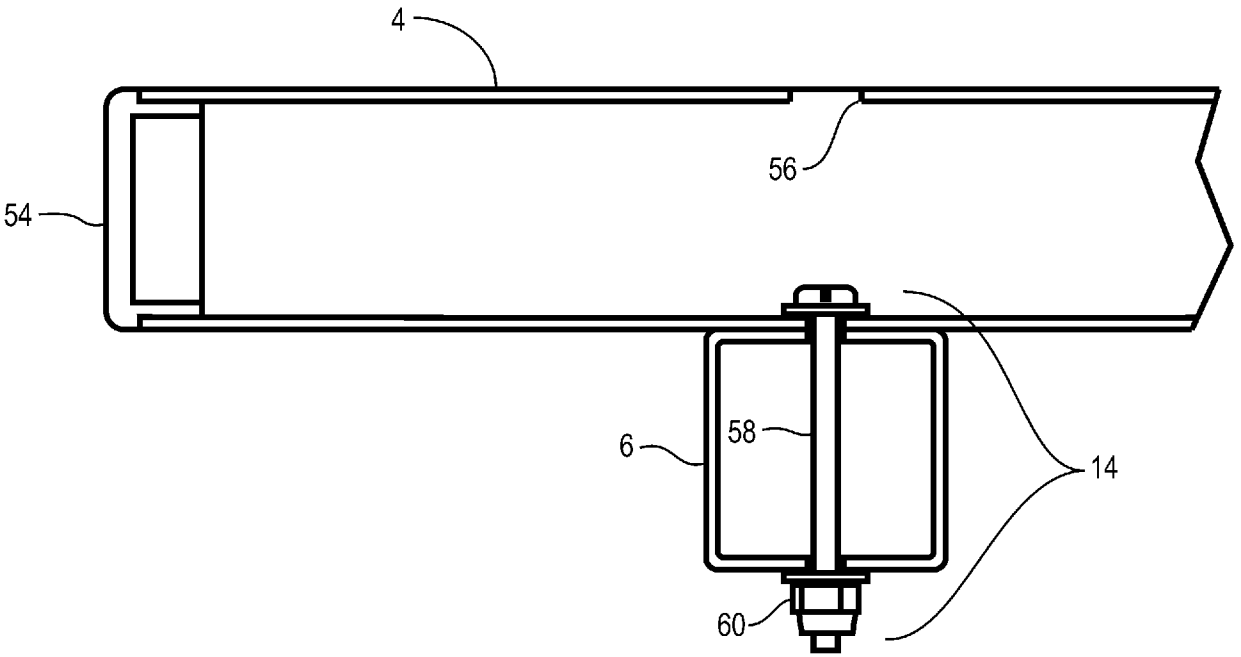
FIG. 7 is a pivot connection detail drawing according to an illustrative embodiment of the present invention.

Reference is directed to FIG. 7, which is a pivot connection detail drawing according to an illustrative embodiment of the present invention. A support beam 4 is illustrated with a rubber plug 53 in its open end. A lateral beam 6 is also shown, which is connected to the support beam 4 using a 3/16" screw 58 and a 3/16" locking nut 60. The nut 60 is lightly tightened so that the beams 4, 6 can rotate about the axis of the screw 58. A 3/8" access hole 56 is formed through the top of the support beam 4 to facilitate insertion and tightening of the screw 58.

Figure 10:
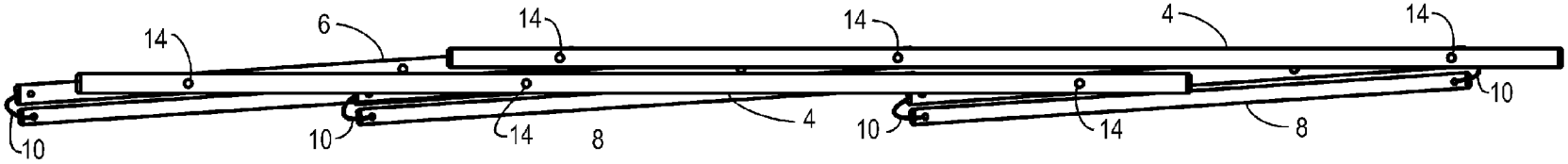
FIG. 10 is a drawing of a support apparatus that is fully closed according to an illustrative embodiment of the present invention.
Figure 9:
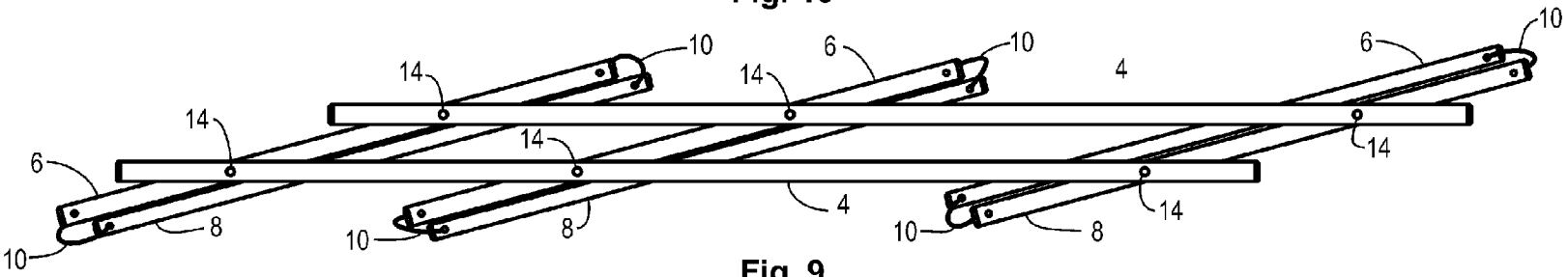
FIG. 9 is a drawing of a support apparatus that is partially opened according to an illustrative embodiment of the present invention.
Figure 8:
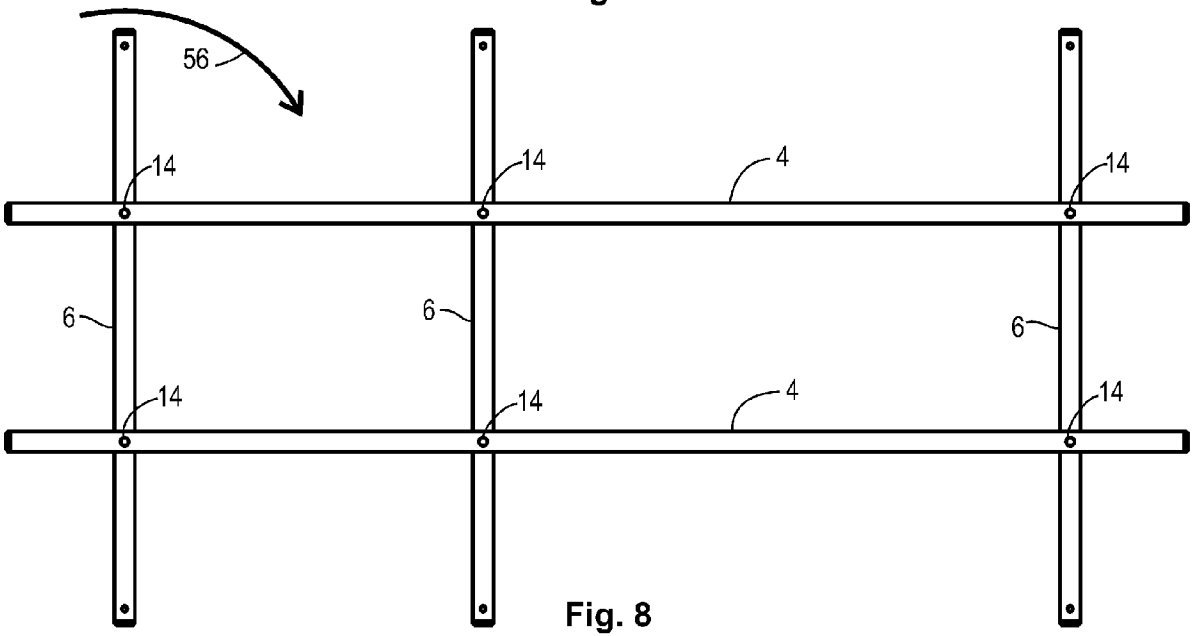
FIG. 8 is a drawing of a support apparatus that is fully opened according to an illustrative embodiment of the present invention.

Reference is directed to FIG. 8, FIG. 9, and FIG. 10, which are drawings of a support frame apparatus 2 as it is rotated between a fully opened (FIG. 8) to a fully collapsed (FIG. 10) positions according to an illustrative embodiment of the present invention. The pivot connectors 14 disposed at each intersection of a support beam 4 and a lateral support beam 6 enable the opened frame of FIG. 8 to be rotated 56 toward a collapsed position. FIG. 9 show the support frame 2 partially collapsed. FIG. 10 illustrates the support frame in the fully collapsed position. In the open position, the support frame 2 defines a rectangular grid structure with the beams 4, 6 at right angles to one another. As the support frame 2 is rotated 56, the grid defines a parallelogram, which collapses until the adjacent support beams 4 come into contact with one another. Similarly, the adjacent lateral support beams 6 also close toward each other. Note that the support frame 2 also includes the pan support beams 8 which are connected with the flexible pan hangers 10. The flexible feature of the pan hangers 10 allows the pan support beams 8 to pack tightly together with the rest of the structure 2. This facilitates packing the entire support frame 2 into a shipping carton.

Figure 11:
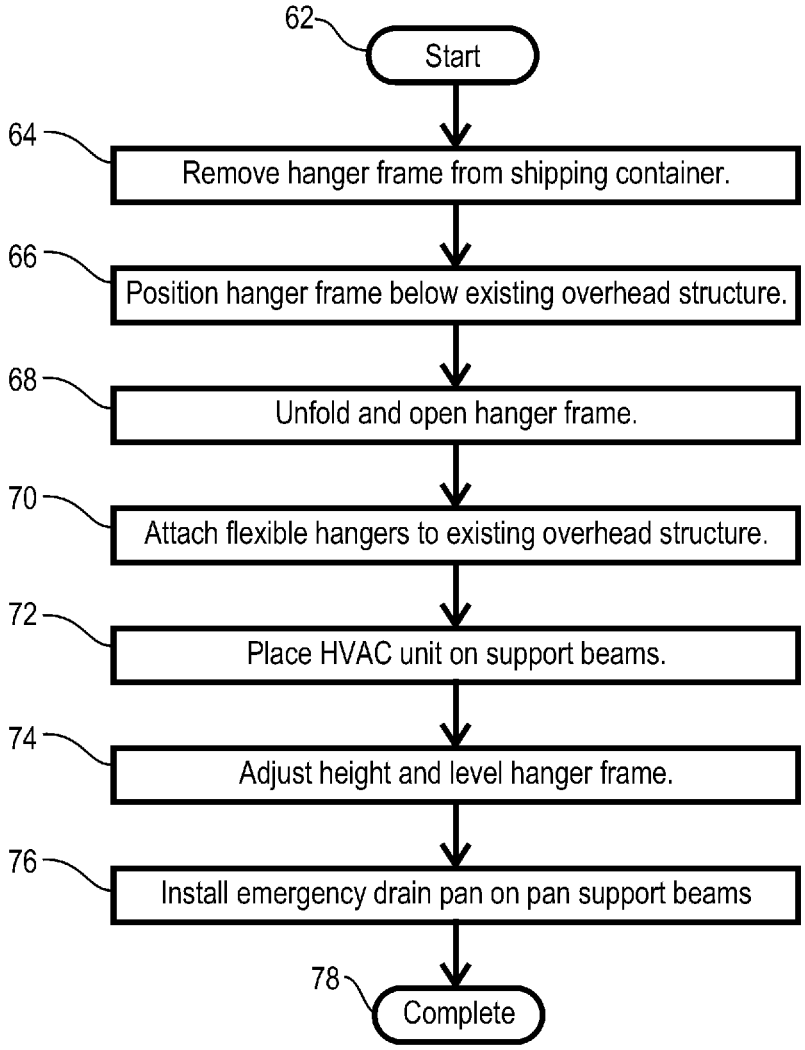
FIG. 11 is an installation flow chart drawing according to an illustrative embodiment of the present invention.

Reference is directed to FIG. 11, which is an installation flow chart drawing according to an illustrative embodiment of the present invention. The installation method begins at step 62 and proceeds to step 64 where the support frame is removed from its shipping container by the installer. At step 66, the hanger frame is moved into the job area and positioned below and existing overhead structure. Having the frame in a collapsed configuration greatly facilitates the movement into the job area. At step 68, the frame is unfolded into a rectangular grid configuration and placed in a horizontal position. At step 70, the flexible hangers are attached to the support frame and to the existing overhead structure. At step 72, the HVAC equipment is placed into position in the support frame. At step 74, the installer adjusted the length to the flexible hangers to position and level the HVAC equipment where needed. At sep 76, the emergency drip pan is placed into position on the support frame and the plumbing connections are made. The process is completed at step 78.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. An apparatus for suspending an HVAC evaporator unit above an emergency drain pan from an existing overhead structure, comprising:

plural lateral beams disposed along a horizontal plane;

a first support beam and a second support beam, for engaging and supporting the HVAC evaporator unit, arranged substantially in parallel to one another, located on top of said plural lateral beams, and each connected to each of said plural lateral beams by a corresponding one of plural pivot connectors, thereby defining a grid arrangement that is foldable about said plural pivot connectors;

plural pan support beams, each aligned below a corresponding one of said plural lateral beams, and each suspended by a pair of pan hangers, which are connected, one each, at two ends of said corresponding one of said plural lateral beams;

plural flexible hangers connected to corresponding ends of said plural lateral beams, for connection to and suspension from the existing overhead support structure, and plural hanger clamps for adjustably engaging said plural flexible hangers into adjustable length loops to facilitate height adjustment and leveling of said horizontal plane.

2. The apparatus of claim 1, and wherein:

said plural lateral beams, said first support member, said second support member, and said plural pan support beams are fabricated from metal structural tubing.

3. The apparatus of claim 1, and wherein:

said a first support beam and a second support beam are spaced apart a distance that effectively supports HVAC evaporator units in the two ton to five ton cooling capacity range, without the need to adjust said distance.

4. The apparatus of claim 1, and wherein:

said plural pivot connectors are threaded fasteners connected between said plural lateral beams and said first support beam or said second support beam.

5. The apparatus of claim 1, and wherein:

the grid arrangement is a parallelogram.

6. The apparatus of claim 1, and wherein:

said pair of pan hangers are fabricated from metal cable.

7. The apparatus of claim 6, and wherein:

said pair of pan hangers are connected to said corresponding one of said pair of plural lateral beams by passing said metal cable through a hole formed therethrough and terminating said metal cable with cable crimp connectors.

8. The apparatus of claim 1, and wherein:

said plural flexible hangers are fabricated from metal cable.

9. The apparatus of claim 8, and wherein:

said plural flexible hangers are connected to said plural lateral beams by passing metal cable through corresponding holes formed through ends of said plural lateral beams.

10. The apparatus of claim 8, and wherein said plural hanger clamps are spring loaded metal cable clamps.

11. An apparatus for suspending an HVAC evaporator unit above an emergency drain pan from an existing overhead structure, comprising:

plural lateral beams, fabricated from metal structural tubing, disposed along a horizontal plane;

a first support beam and a second support beam, fabricated from metal structural tubing, for engaging and supporting the HVAC evaporator unit, arranged substantially in parallel to one another, located on top of said plural lateral beams, and each connected to each of said plural lateral beams by a corresponding one of plural pivot connectors, which are threaded fasteners connected between said plural lateral beams and said first support beam or said second support beam, which thereby define a parallelogram grid arrangement that is foldable about said plural pivot connectors;

plural pan support beams, fabricated from metal structural tubing, each aligned below a corresponding one of said plural lateral beams, and each suspended by a pair of pan hangers, fabricated from metal cable, which are connected, one each, at two ends of said corresponding one of said plural lateral beams by passing said metal cable through a hole formed therethrough and terminating said metal cable with cable crimp connectors;

plural flexible hangers, fabricated from metal cable, connected to corresponding ends of said plural lateral beams by passing said metal cable through corresponding holes formed through ends of said plural lateral beams, for connection to and suspension from the existing overhead support structure, and plural metal cable hanger clamps for adjustably engaging said plural flexible hangers into adjustable length loops to facilitate height adjustment and leveling of said horizontal plane.

12. A method of suspending an HVAC evaporator unit and an emergency drain pan using an apparatus consisting of plural lateral beams disposed along a horizontal plane, and a first and second support beam arranged substantially in parallel to one another, located on top of the plural lateral beams, and each connected to each of the plural lateral beams by a corresponding one of plural pivot connectors, thereby defining a grid arrangement that is foldable about the plural pivot connectors, and, plural pan support beams, each aligned below a corresponding one of the plural lateral beams, and each suspended by a pair of pan hangers, which are connected, one each, at two ends of said corresponding one of said plural lateral beams, the method comprising the steps of:

positioning the apparatus below an existing overhead structure;

unfolding the apparatus about the plural pivot connectors into a square grid arrangement;

attaching plural flexible hangers between the existing overhead structure and corresponding ends of the plural lateral beams;

engaging the HVAC evaporator unit on the first support beam and a second support beam;

adjusting the height and leveling the apparatus along a horizontal plane using plural hanger clamps connected to the plural flexible hangers, and installing the emergency drain pan on the plural pan support beams.

13. The method of claim 12, and wherein the first and second support beams are spaced apart for supporting an HVAC evaporator unit having a capacity in the two ton to five ton cooling capacity range.

14. The method of claim 12, and wherein the grid arrangement is unfolded from a parallelogram arrangement.

15. The method of claim 14, further comprising the step of:

removing the apparatus in the parallelogram arrangement from a shipping container.

16. The method of claim 12, and wherein the plural flexible hangers are fabricated from metal cable, and further comprising the steps of:

passing the metal cables through corresponding holes formed through ends of the plural lateral beams.

17. The method of claim 16, further comprising the steps of:

drilling plural holes through the overhead support structure, and passing the metal cables through said plural holes.

18. The method of claim 16, and wherein the plural hanger clamps are spring loaded metal cable clamps.

* * * * *